US011134812B2

(12) United States Patent
Cicero

(10) Patent No.: US 11,134,812 B2
(45) Date of Patent: Oct. 5, 2021

(54) WIPE DISPENSER

(71) Applicant: TOP WIPE, LLC, Phoenix, AZ (US)

(72) Inventor: Aaron Cicero, Phoenix, AZ (US)

(73) Assignee: Top Wipe, LLC, Phoenix, AZ (US)

( * ) Notice: Subject to any disclaimer, the term of this patent is extended or adjusted under 35 U.S.C. 154(b) by 0 days.

(21) Appl. No.: 16/594,634

(22) Filed: Oct. 7, 2019

(65) Prior Publication Data

US 2020/0113394 A1 Apr. 16, 2020

Related U.S. Application Data

(60) Provisional application No. 62/744,447, filed on Oct. 11, 2018.

(51) Int. Cl.
*A47K 10/42* (2006.01)
*A47K 10/32* (2006.01)

(52) U.S. Cl.
CPC .... *A47K 10/424* (2013.01); *A47K 2010/3266* (2013.01)

(58) Field of Classification Search
CPC ..... G06Q 30/0601; G07F 5/18; G07F 9/002; G07F 9/023; G07F 11/08; G07F 11/10; G07F 11/54; G07F 17/32
See application file for complete search history.

(56) References Cited

U.S. PATENT DOCUMENTS 2,685,365 A * 8/1954 Sieven ..... A47K 10/38 206/410
4,106,616 A * 8/1978 Boone ..... A47K 10/32 206/233
4,798,312 A * 1/1989 Scheiber ..... A47K 10/32 206/233
5,897,074 A 4/1999 Marino
6,698,683 B2 * 3/2004 Young ..... A47K 10/3836 242/594
6,997,342 B2 * 2/2006 Mitchell ..... B65D 5/4208 221/282
7,357,350 B1 * 4/2008 Rogers ..... A47K 10/38 242/594.5
8,910,826 B2 * 12/2014 Rapala ..... A47K 10/185 221/45
9,526,383 B2 * 12/2016 Delaney ..... A47K 10/38
D785,363 S * 5/2017 Khan ..... D6/518
10,512,369 B2 * 12/2019 Cuenca ..... A47K 10/3836
(Continued)

OTHER PUBLICATIONS

PCT International Search Report and Written Opinion, corresponding to PCT Application No. PCT/US2019/054969, dated Dec. 4, 2019, 11 pages.

*Primary Examiner* — Gene O Crawford
*Assistant Examiner* — Kelvin L Randall, Jr.
(74) *Attorney, Agent, or Firm* — Fennemore Craig, P.C.

(57) ABSTRACT

A bathroom wipe dispenser dispenses both toilet paper and wet wipes. The dispenser has a tube that receives an ordinary toilet paper spindle and, consequently, the dispenser may be hung from a majority of the toilet paper dispensers in residential use today. The tube also fits within an ordinary roll of toilet paper. An arm hangs down from one side of the tube. The arm supports a wet wipe dispenser hanging beneath the arm. The wet wipe dispenser carries a package of wet wipes and has a bottom opening that provides access as wet wipes are dispensed from the package.

5 Claims, 10 Drawing Sheets

(56) References Cited

U.S. PATENT DOCUMENTS

| | | | | |
|---|---|---|---|---|
| 2005/0109790 | A1* | 5/2005 | Hsu | B65D 83/0805 221/34 |
| 2005/0284881 | A1* | 12/2005 | Haddad | A47K 10/42 221/282 |
| 2009/0200332 | A1* | 8/2009 | Intini | B65D 83/0409 221/154 |
| 2010/0025419 | A1 | 2/2010 | Yaros | |
| 2010/0264157 | A1* | 10/2010 | Bailey | B65D 83/02 221/1 |
| 2011/0024586 | A1* | 2/2011 | Brinkdopke | A47K 10/421 248/205.4 |
| 2012/0305589 | A1* | 12/2012 | Gerschwiler Steck | A47K 10/42 221/199 |
| 2015/0083743 | A1* | 3/2015 | D'Angelo | A47K 10/38 221/45 |
| 2015/0374182 | A1* | 12/2015 | Delaney | A47K 10/38 221/1 |
| 2017/0164794 | A1* | 6/2017 | Delaney | A47K 10/426 |
| 2017/0202409 | A1* | 7/2017 | Cahalan | A47K 10/421 |
| 2018/0049602 | A1* | 2/2018 | Delaney | A47K 10/426 |
| 2018/0125309 | A1* | 5/2018 | Brown | A47K 10/3836 |

* cited by examiner

WIPE DISPENSER

RELATED APPLICATIONS

This application claims benefit of priority to U.S. provisional patent application no. 62/744,447 filed on Oct. 11, 2018, which is hereby incorporated by reference to the same extent as though fully replicated herein.

BACKGROUND

Field of the Invention

The present disclosure pertains to the field of bathroom wipe dispensers. More particularly, a dispenser facilitates access to both toilet paper and wet wipes.

Description of the Related Art

Whether for toddler care or adult uses, people are increasingly using wet wipes in place of toilet paper. This is shown in the art, for example, where U.S. Pat. D552,902 to Sadeh et al. shows a combined dispenser for toilet paper and wet wipes. The wet wipes dispenser is mounted above the toilet paper, which is problematic if the wet wipes dispenser leaks liquid onto the toilet paper below. Similarly, U.S. Pat. No. 6,827,309 to Newmann et al. shows a wet wipe dispenser that may be mounted on a conventional toilet paper spindle. To the extent that the wet wipe dispenser of Newmann et al. may also dispense toilet paper, the wet wipes dispenser also resides above the toilet paper spindle.

Locating the wet wipes dispenser above the toilet paper is best done by securing the dispenser to a wall by the use of adhesive or screws. This prevents the wet wipes dispenser from pivoting down to an awkward position that juts out from the wall. Since these wet wipes dispensers are sold as aftermarket add-ons and are used to retrofit existing residential-style toilet paper holders, it is desirable to have a universal dispenser that will retrofit most of the toilet paper dispensers in use today. Where some of these dispensers are recessed into the wall and others are not recessed, it is difficult or impossible to provide a single model of wet wipe dispenser that works as a universal retrofit device.

U.S. Pat. No. 7,128,235 to Haddad et al. is an attempt to provide a bathroom caddy for disposable wet wipes where the wet wipes reside below the toilet paper. The caddy has a tray upon which a may be placed a box of wet wipes. The tray is held by a pair of opposed arms that descend downwardly from hooks that mount upon opposite ends of a toilet paper spindle. While this system presents the wet wipes below the toilet paper and, consequently, protects the toilet paper from leaks, the arms have excessive length that present the wet wipes at too low of an elevation which is uncomfortable to use.

SUMMARY

The presently disclosed instrumentalities advance the art and overcome the problems outlined above by providing a compact bathroom wipe dispenser that provides convenient access to both toilet paper and wet wipes while protecting the toilet paper from leaks. The bathroom wipe dispenser may be used to retrofit conventional dispensing systems for residential use of rolled toilet paper as are found in most residences today.

According to one embodiment, a bathroom wipe dispenser includes a tube that is dimensionally compatible with retrofitting an existing toilet paper spindle to hold a dual dispenser of both toilet paper and wet wipes. The tube is constructed and to dispense toilet paper while the toilet paper spindle is inserted in the tube. A single arm hangs downwardly from a first end of the tube, which supports a wet wipe dispenser hanging from the arm at an end of the arm remote from the tube.

In one aspect, the end of the arm attaches to the wet wipe dispenser proximate a distal end of the wet wipe dispenser. The arm may be integrally formed with the wet wipe dispenser or, alternatively, coupling structure such as a groove and channel assembly may be used for selectively attaching to and detaching the arm from the wet wipe dispenser. The ability to separate the arm in this manner facilitates smaller packaging for shipment and sale of the bathroom wipe dispenser.

In one aspect, the arm has a height H and the dispenser has a depth dimension D that is perpendicular to H. The depth dimension D may be sufficient to cause an angle of inclination θ that departs from a vertical orientation as would occur when the arm hangs vertically without abutment to adjacent wall structure in the intended environment of use. The angle of inclination occurs by abutment of the wet wipe dispenser against a wall or other structure to the rear of the bathroom wipe dispenser. The angle of inclination may be any angle from 0 to 45°. For some uses, the preferred angle of inclination may range from 20° and 40°. An angle of inclination in this range facilitates access to the bottom of the wet wipe dispenser without interfering with access to the toilet paper mounted on the tube above.

In one aspect, the wet wipe dispenser has a top and a bottom. The bottom is constructed and arranged to dispense wet wipes through an opening in the bottom. The opening may have beveled edges or a chamfer of complimentary dimensions with respect to the package for enhanced retention thereof proximate the opening.

In one embodiment, the wet wipe dispenser is formed as a bivalve case. An interior cavity retains and is dimensionally compatible with a package of wet wipes having predetermined dimensions proximate to the opening. This package may be, for example, a commercially available package. In one aspect, a spring may bias the package of wet wipes towards a bottom opening when the bivalve case is closed.

In one embodiment, the wet wipe dispenser has a removable door that may be opened and closed as needed for renewal of a wet wipe package that may reside within the wet wipe dispenser. In one aspect, the door may be provided with door has a bump-out that is operably positioned to squeeze the package when the package is inserted into the wet wipe dispenser.

In one embodiment, the wet wipe dispenser has a main body and a sliding nose of complimentary dimensions with respect to the main body. The dimensions are such that the sliding nose and the main body slidingly engage in a mating relationship that forms an interior cavity within the wet wipe dispenser. The mating relationship also forms a bottom opening as a union between the sliding nose and the main body.

DETAILED DESCRIPTION

Figure 1:
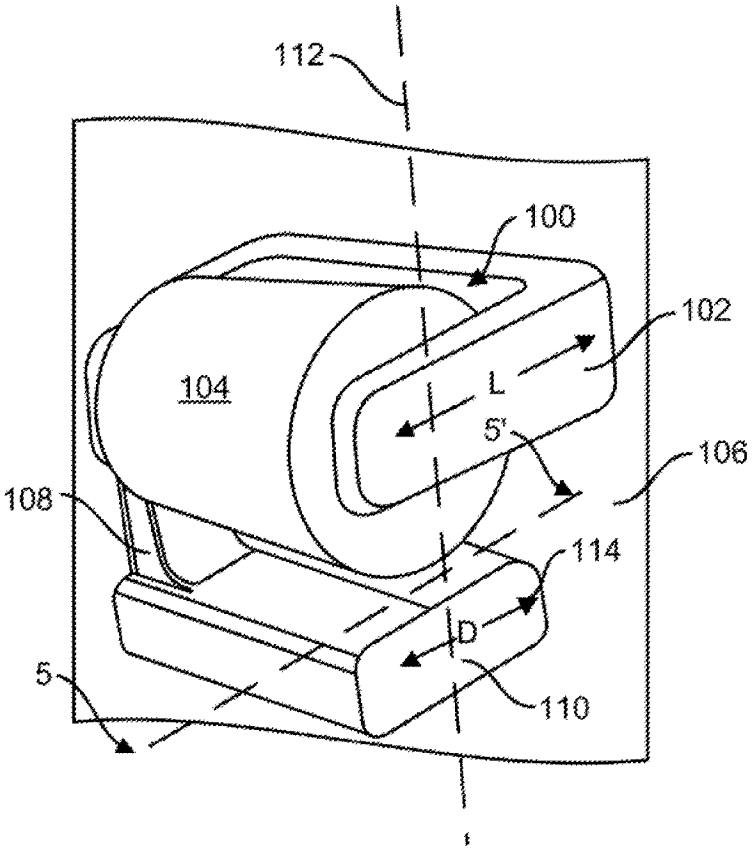
FIG. 1 shows a bathroom wipe dispenser that provides both toilet paper and wet wipes from a household toilet paper bracket according to the presently disclosed instrumentalities.

FIG. 1 is a right front perspective view showing a bathroom wipe dispenser 100 mounted on a conventional bracket 102. The bracket 102 may be purchased on commercial order and is merely one type of toilet paper holder commonly in commercial use. As shown in FIG. 1, the bracket 102 is affixed to a restroom wall 106. In addition to dispensing toilet paper 104, a downwardly descending arm 108 carries a wet wipe dispenser 110. Thus, a person who is using a toilet (not shown) may choose between the use of toilet paper 104 and wet wipes from the wet wipe dispenser 110. A center line 112 indicates medial symmetry from a side perspective as to the embodiment of FIG. 1, but as used herein the word "medial" means that a position observed in plan view is aligned with a center of gravity. Here the center line 112 is substantially vertical indicating that the bathroom wipe dispenser 100 is squared away with respect to wall 106, essentially that the bathroom wipe dispenser 100 is able to hang freely without contacting the wall 106, or else that back surface 114 is in light contact with the wall 106. This is possible in a non-recessed wall 106 because a medial depth D between the center line 112 and the back surface 114 is equal to or lesser than the distance L between the wall 106 and the center of the toilet paper spindle (not shown) that is mounted on bracket 102.

Figure 2:
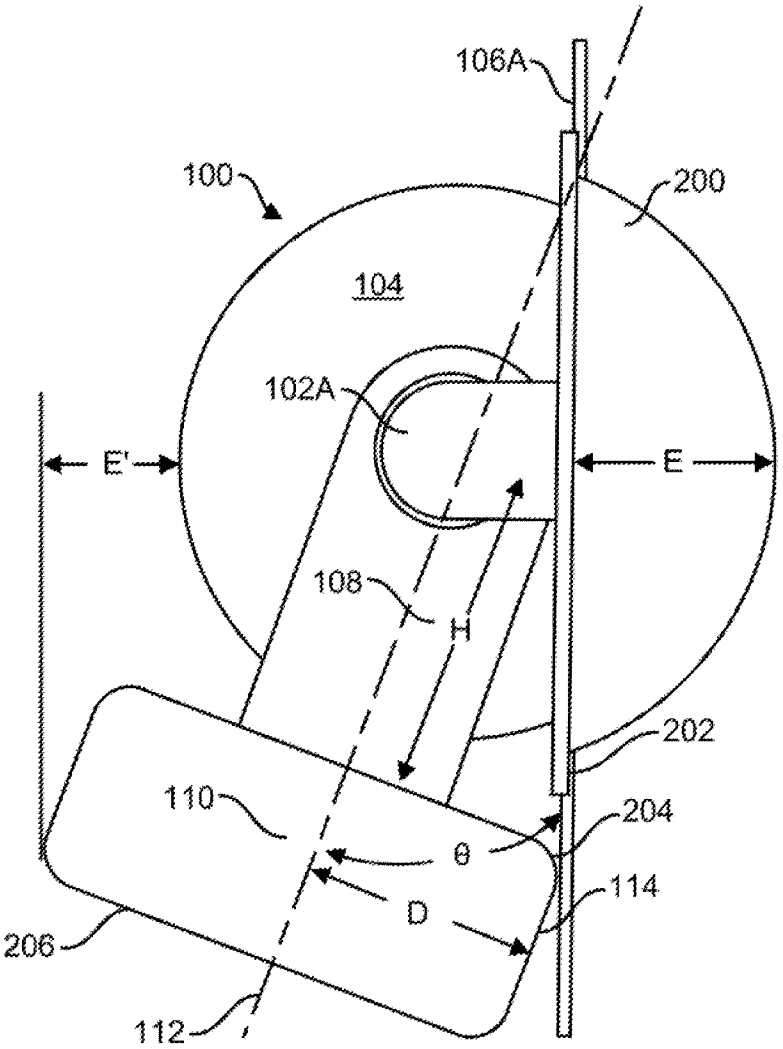
FIG. 2 shows the bathroom wipe dispenser mounted in a different type of toilet paper holder.

FIG. 2 shows the bathroom wipe dispenser 100 of FIG. 1 mounted in an escutcheon 200 covering a recess 202 formed in wall 106A. A recessed mount of this nature may be utilized, for example, for aesthetics or to preserve a range of motion in tight bathroom spaces. In this case the center line 112 is substantially off-vertical because bracket 102A has a length that is much shorter than the length L (see FIG. 1). This causes a back surface 114 of the wet wipe dispenser 110 to abut the wall 106A at a rounded corner, thus tilting the center line 112 at an acute angle θ relative to the wall 106A.

The angle θ is an angle of inclination or tilt from vertical having a magnitude that is equal to or less than about 45° so as not to interfere with access to the toilet paper 104. It is especially preferred in some embodiments that the tilt angle is between 20° and 40° for improved presentment of wet wipes from a bottom surface 206 in the intended environment of use. In these embodiments, D may be greater than H to arrive at the correct angle of inclination θ.

Where the average roll of toilet paper has an outer diameter of 11 to 12 centimeters, the height H, which is the height of the arm 108 to the center of the toilet paper spindle (not shown), should be at least 6 centimeters and is preferably from 6 to 12 centimeters, most preferably from 8 to 10 centimeters. Where the height H is greater than the depth D the depth E of the roll of toilet paper 104 in escutcheon 200 will be slightly greater than a comparable distance E', which is the radial outboard increase in depth due to pivoting of arm 108 caused by the abutment of back surface 114 against the wall 106A. The fact that E>E' when H>D preserves at least some of the benefit of using a recessed mount. Even so, care is preferably taken that the height H is not too great, since this may position a wet wipe dispensing surface 206 at a level that is too low for comfortable use. Accordingly, H is preferably greater than D and within a range from 6 to 12 centimeters in height between the top of dispenser 110 and the center of the toilet paper spindle. H is preferably from 8 to 10 centimeters in height. Since the arm 108 does not necessarily have to be co-located at the center of the dispenser 110, in these alternative embodiments the height H may be taken as the shortest line extending from the center of the toilet paper spindle to the top of the dispenser 110. In either case, the medial distance D remains as one half the total depth of the dispenser 110 because this aligns dimension D with a center of gravity of the wet wipe dispenser 110.

Figure 3:
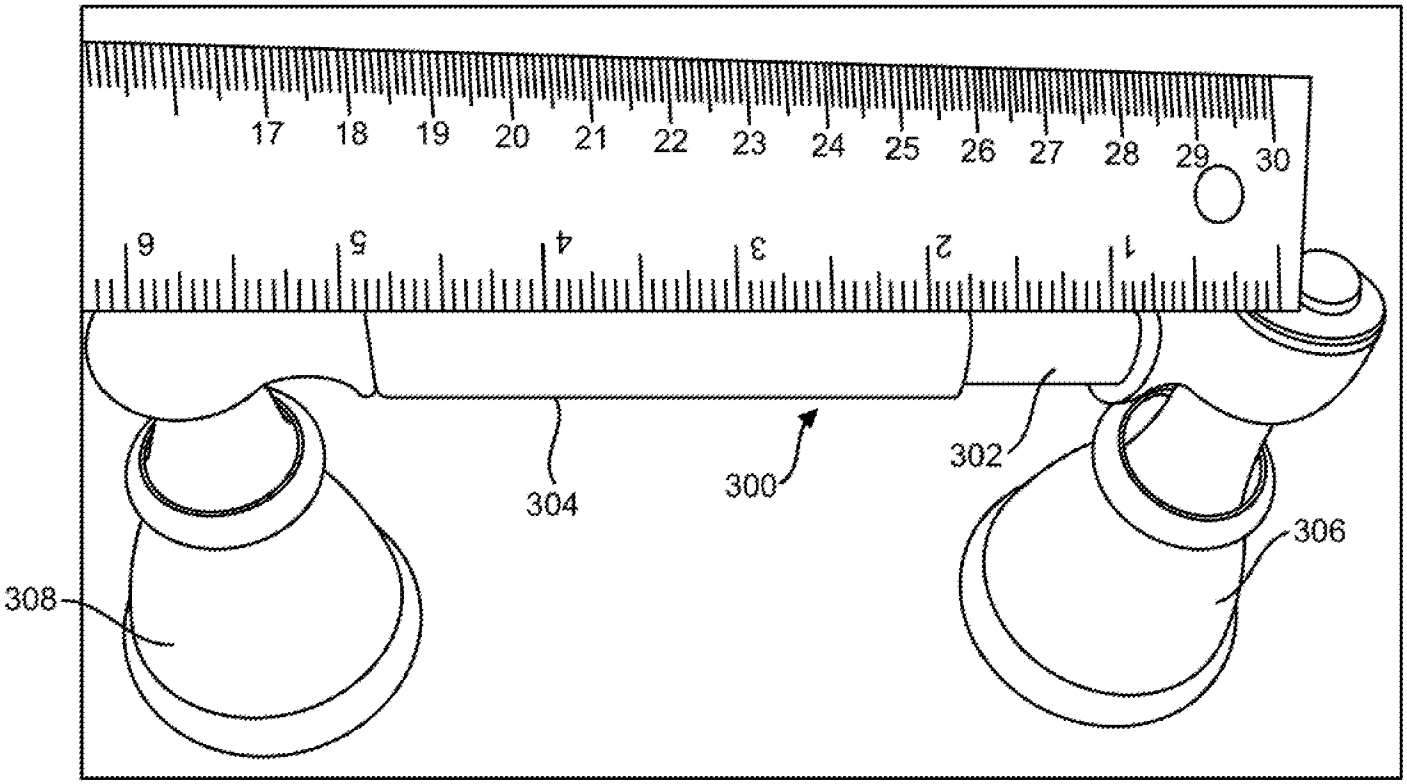
(PRIOR ART) FIG. 3
FIG. 3 shows a conventional toilet paper holder of the prior art including a toilet paper spindle.

The standard mounting height for toilet paper dispensers is on center to the toilet paper spindle twenty six inches (66 centimeters) from the floor. FIG. 3 shows one example of a conventional toilet paper spindle 300 that may be purchased on commercial order. The toilet paper spindle 300 is made of an inner tubular body 302 that is telescopingly received into an outer tubular body 304. An inner compression spring (not shown) biases the tubular bodies 302, 304 into wall mounts 306, 308, which in combination may function as does the bracket 102 of FIG. 1. A variety of spindles are known in the art and may also include, for example, threaded rod or wire that passes through the cardboard tube center (not shown) of a standard roll of toilet paper. As shown in FIG. 3, the toilet paper spindle 300 spans a distance of 5½ inches (14 centimeters). The average roll of toilet paper is about 10 centimeters wide, and so this spindle in the intended environment of use has a tolerance of 4 spare centimeters to accommodate rolls of toilet paper that are wider than average. Generally speaking, spindles in residential use frequently span from 5 to 6 inches (13 to 15 centimeters).

Figure 4:
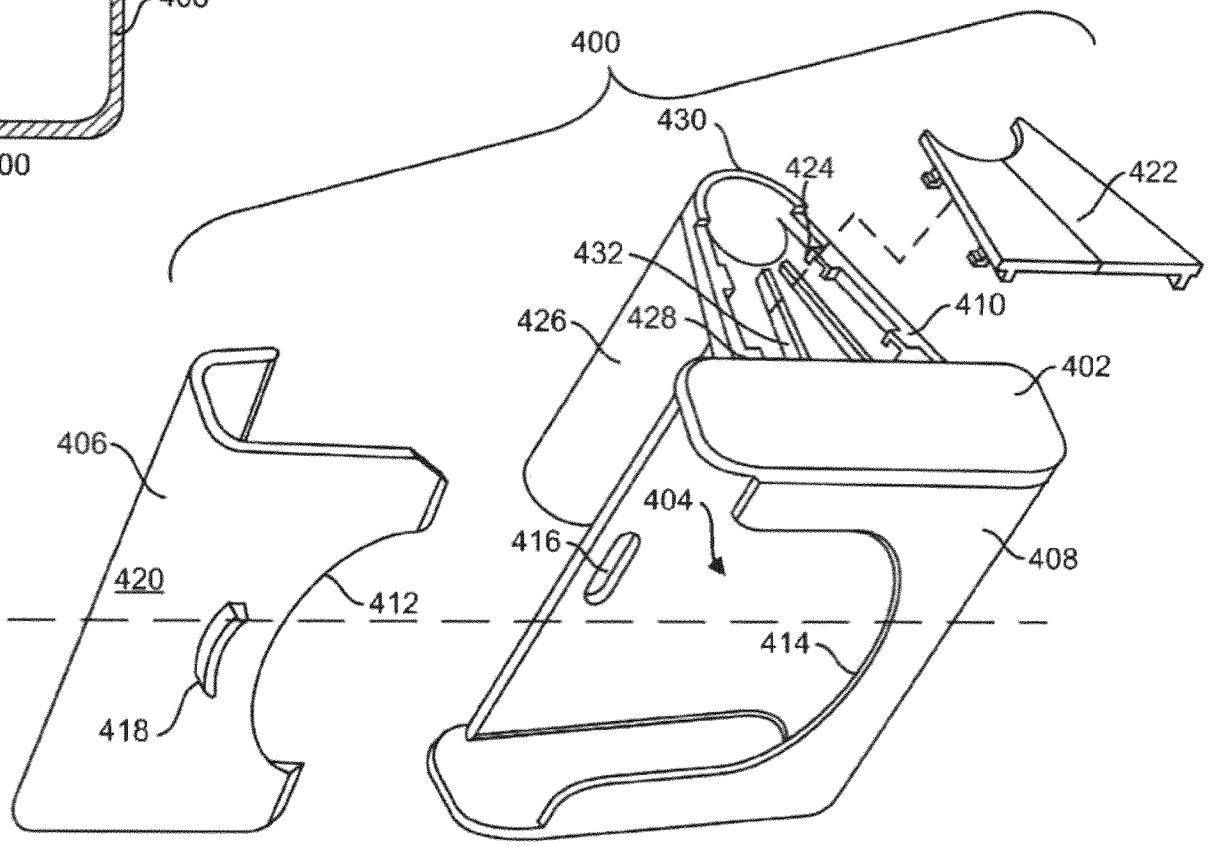
FIG. 4 is an assembly view of the bathroom wipe dispenser according to a first embodiment.

FIG. 4 is an assembly view of a wet wipe dispenser 400, which may be the bathroom wipe dispenser 100 according to one embodiment. A wet wipe dispenser 402 corresponds to wet wipe dispenser 110 as described in context of FIGS. 1 and 2. A cavity 404 is formed by mating engagement between a sliding nose 406 and a main body 408 connected to arm 410. The sliding nose 406 is received within the main body 408 to a point where a flexi nib (not shown; see FIG. 5) snaps into opening 416. A finger tab 418 facilitates removal of the sliding nose 406 when the flexi nib is manually depressed. The flexi nib resides on a rounded wall 420 acting as a spring that biases the flexi nib into opening 416. An ornamental side plate 422 snaps into the arm 410 to cover recess 424. The arm 410 is integrally formed with a tube 426 having both: (1) an outside diameter that will fit within the cardboard roll within an ordinary roll of toilet paper, and (2) an inside diameter sized to receive a toilet paper spindle, such as is shown in FIG. 3. Where there is a single arm 410 located proximate a distal end 428 of the bathroom wipe dispenser 400, the tube 426 imparts lateral stability that mitigates twisting in the intended environment of use. The inner diameter of the cardboard tube inside an ordinary roll of toilet paper is about 4 centimeters, which means there is plenty of room for tube 426 to fit within the cardboard tube when also sized to accept a toilet paper spindle. The arm 424 includes a first end 430 mounted to the tube 426 and a second end 432 attached to the wet wipe dispenser 402.

Figure 5:
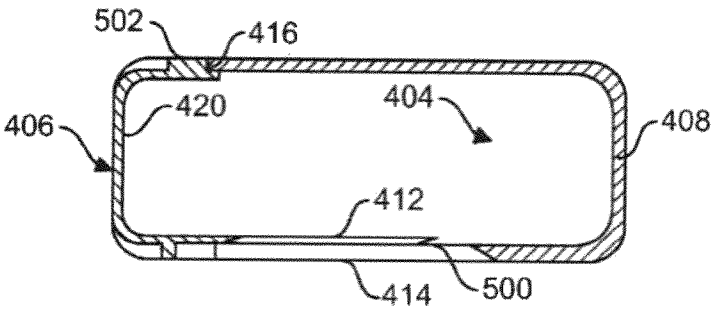
FIG. 5 is an midsection view of the bathroom wipe dispenser according to the first embodiment.

FIG. 5 is a midsection view taken along line 5-5' of FIG. 1 when the bathroom wipe dispenser 100 is the embodiment of bathroom wipe dispenser 400 as shown in FIG. 4. Mating engagement of the sliding nose 406 with main body 408 produces the cavity 404, as well as opening 500 defined by beveled edges 412, 414. Here the flexi nib 502 is shown being received within opening 416.

Figure 7:
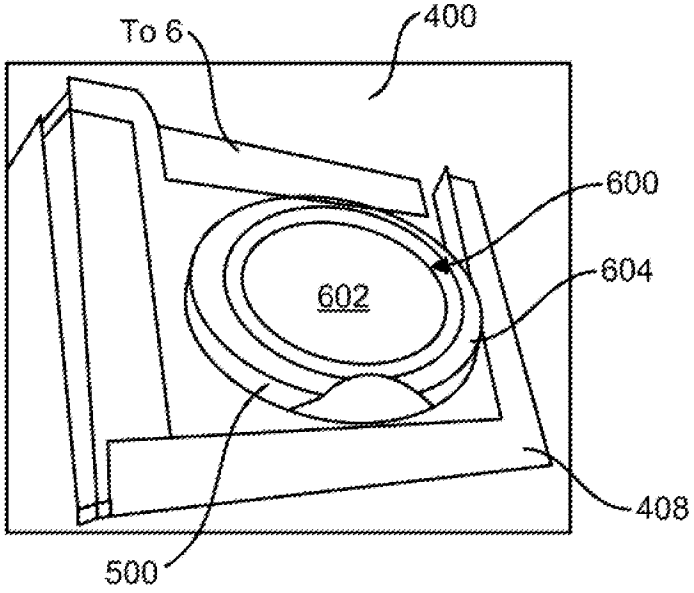
FIG. 7 shows the fully assembled bathroom wipe dispenser according to the first embodiment.
Figure 6:
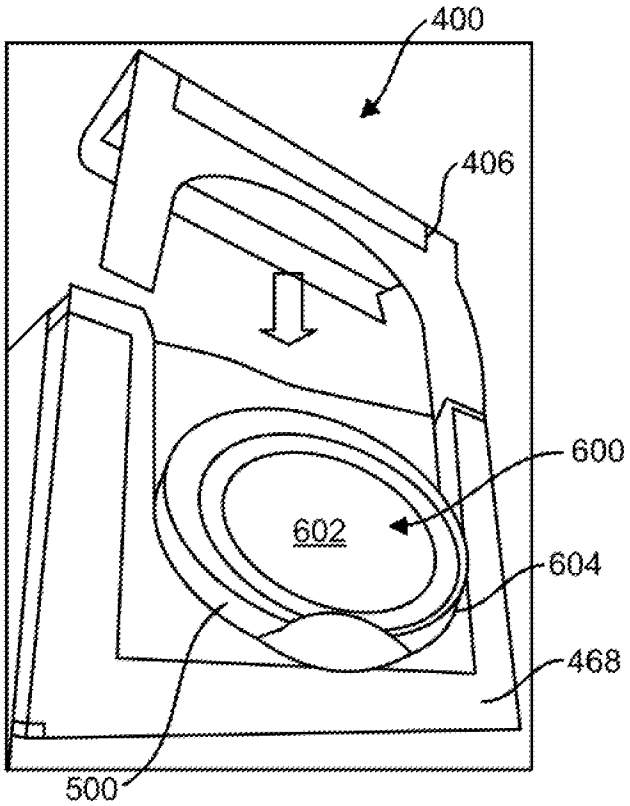
FIG. 6 shows the bathroom wipe dispenser from a bottom perspective according to the first embodiment being assembled with a commercially available package of wet wipes retained within a bottom opening therein.

The opening 500 and cavity 404 are preferably sized with dimensions complimentary to a commercially available cartridge or package of wet wipes. By way of example, FIG. 6 is a bottom view showing a refill package 600 of Cottonelle® wipes as may be purchased on commercial order from Kimberly Clark Worldwide, Inc. of Neenah Wis. The package 600 has a lid 602 that snaps onto a rim or lip 604. The beveled edges 412, 414 fit under the lip 604 as the sliding nose 406 mates with the main body 408 FIG. 7 shows the fully assembled bathroom wipe dispenser 400. It will be appreciated that the wet wipe dispensers 110, 402 may be provided with adapters to accommodate a wide variety of commercially available wet wipe dispensers.

Figures 8, 8A:
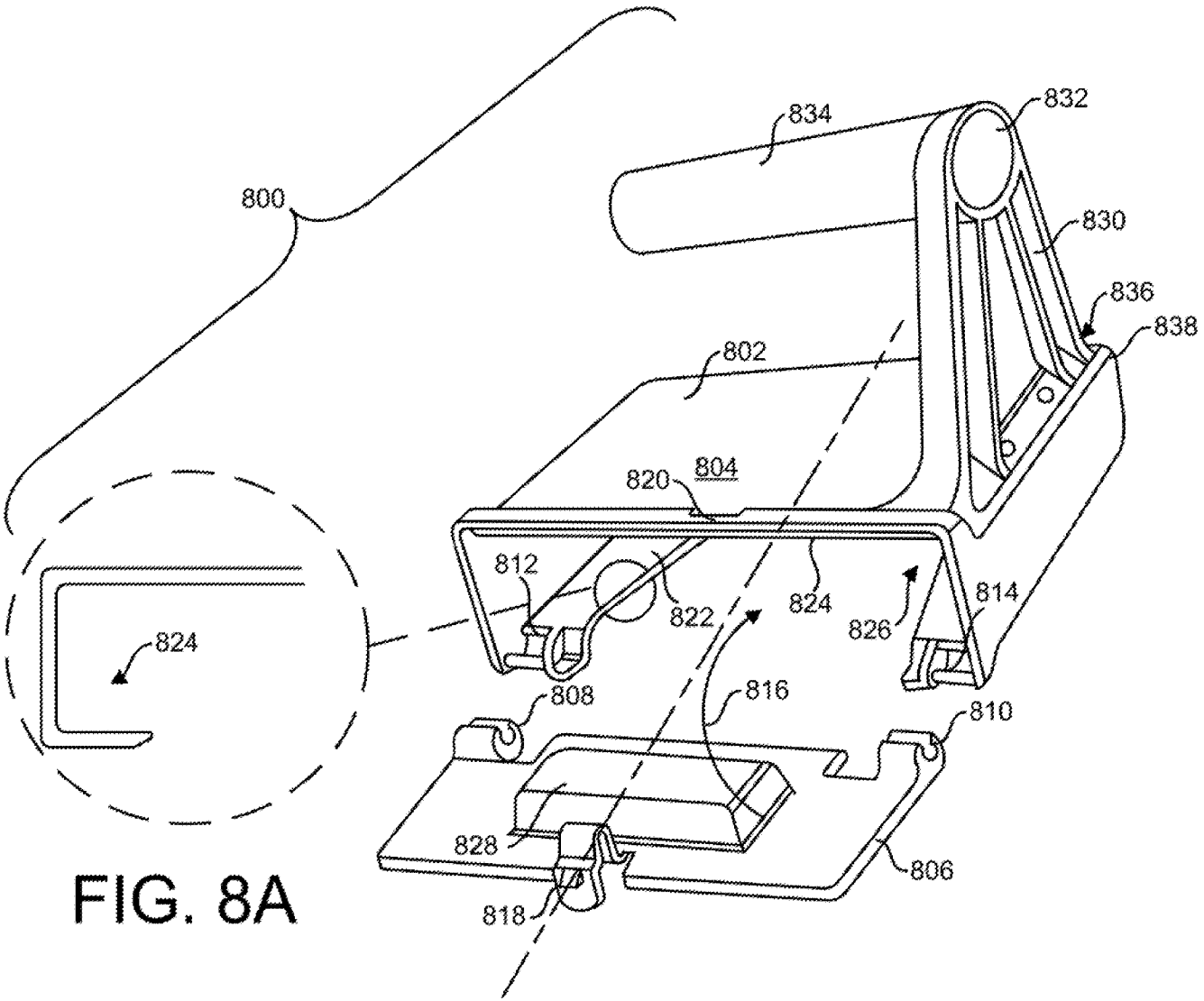
FIG. 8 is an assembly view of the bathroom wipe dispenser according to a second embodiment.
FIG. 8A provides expanded detail showing a chamfer that may be used to retain a package of wet wipes in a bottom opening of the second embodiment.

FIG. 8 is an assembly view of a wet wipe dispenser 800, which may be the bathroom wipe dispenser 100 according to another embodiment. A wet wipe dispenser 802 is formed as a union between main compartment 804 and door 806. Pincers 808, 810 are integrally formed with the door 806 for complementary engagement with receptacles 812, 814. This permits assembly by pivoting motion 816 such that a snap clip 818 engages catch 820 to form cavity 822. A chamfered lip 824 demarcates a bottom opening 826, which may be used to retain a package of wet wipes 600 as shown above in context of FIGS. 6 and 7. FIG. 8A is an expanded view providing additional detail about the nature of chamfered lip 824. The door 806 optionally but preferably contains a bump-out to securely squeeze the package 600 to enhance retention in the cavity 822. An arm 830 includes a first end 832 mounted to tube 834 and a second end 836 that is remote from the first end 832 and connects proximate a distal end 838 of the wet wipe dispenser 802 for support thereof. The tube 834 functions as described above in respect of tube 426.

Figure 9:
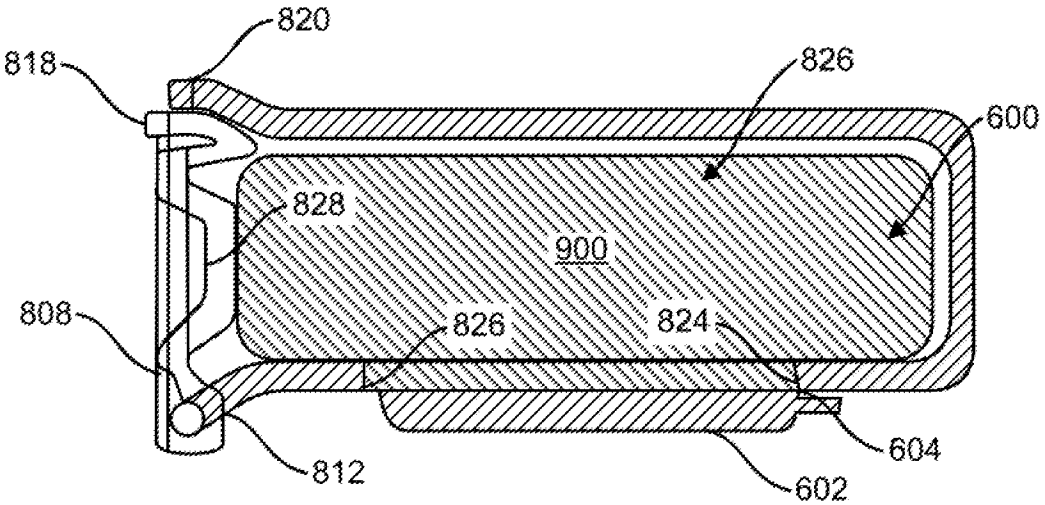
FIG. 9 is an midsection view of the bathroom wipe dispenser according to the second embodiment.

FIG. 9 is a midsection taken along line 5-5' of FIG. 1 when the bathroom wipe dispenser 100 is the embodiment of bathroom wipe dispenser 800 as shown in FIG. 8. Here the package 600 is shown securely retained in the cavity 824 with the rim 604 retained in the chamfered edge 824 and the bump-out 828 squeezing the package body 900 which presents wet wipes for use upon removal of the lid 602.

Figure 10:
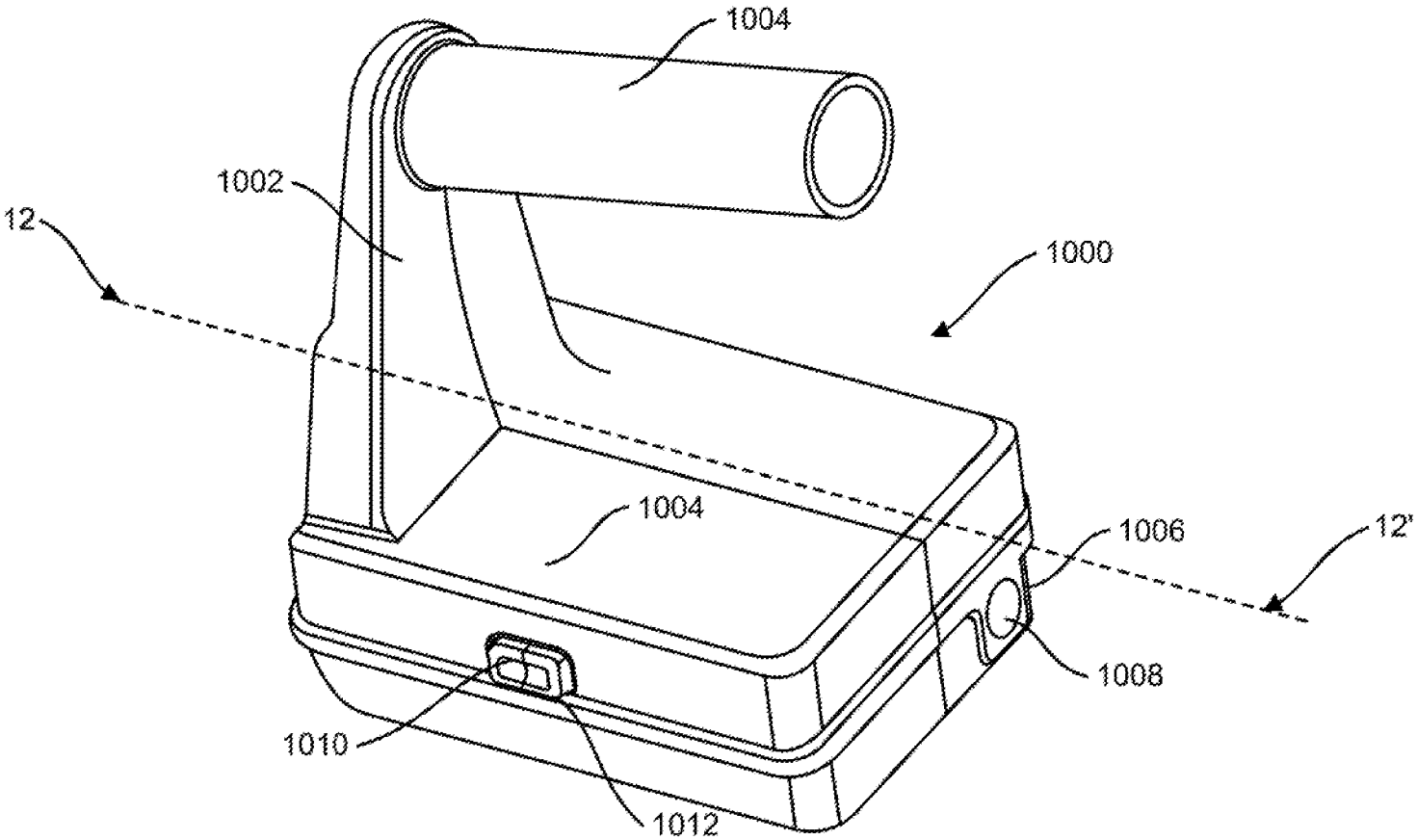
FIG. 10 shows the bathroom wipe dispenser according to a third embodiment.

FIG. 10 shows a third embodiment 1000 of the bathroom wipe dispenser 100. The embodiment 1000 includes an arm 1002 that is threadably coupled with or adhered to tube 1004 and integrally formed with compartment top 1004. The compartment top 1004 includes an opposed pair of downwardly extending ears 1006 that form hinges when mated with cylindrical bosses 1008 of compartment bottom 1010. A spring locking nib of the bottom 1010 engages opening 1012 to form an interior cavity (not shown).

Figure 11:
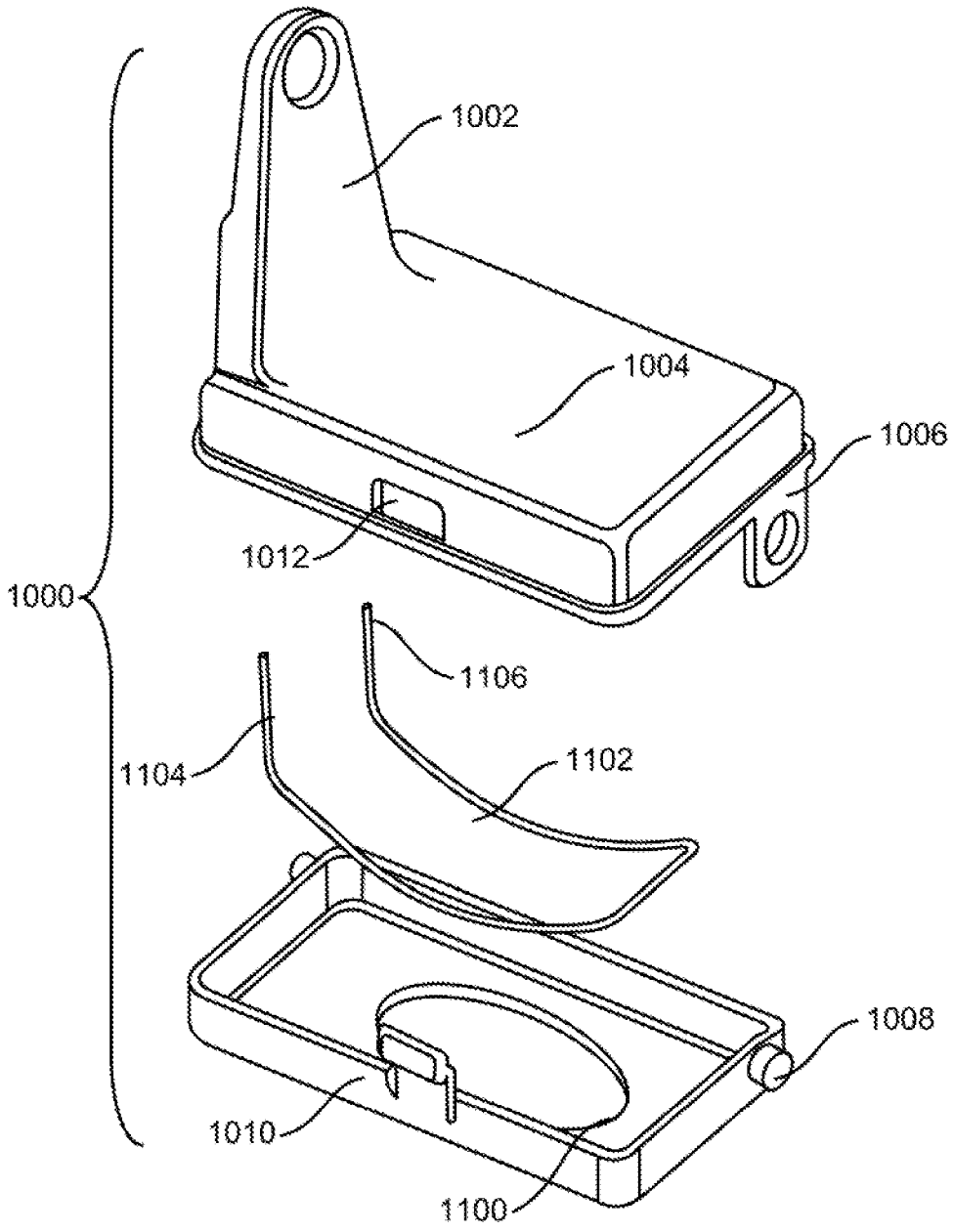
FIG. 11 is an assembly view of the bathroom wipe dispenser of the third embodiment.

FIG. 11 is an assembly view of the third embodiment 1000. Here the bottom 1010 does not have separable components to define a bottom opening 1100. Therefore, a spring 1102 that is stabilized by ends 1104, 1106 received within the arm 1102 is provided to exert downward bias towards the opening 1100. Thus, in context of the package 600 discussed above, the lid 602 may be removed so that lip 602 is biased towards the opening 1100, which is of complimentary dimensions with respect to the lip 602 for the purpose of stabilizing the lip 602 proximate the opening 1100 when dispensing wet wipes through the opening 1100.

Figure 12:
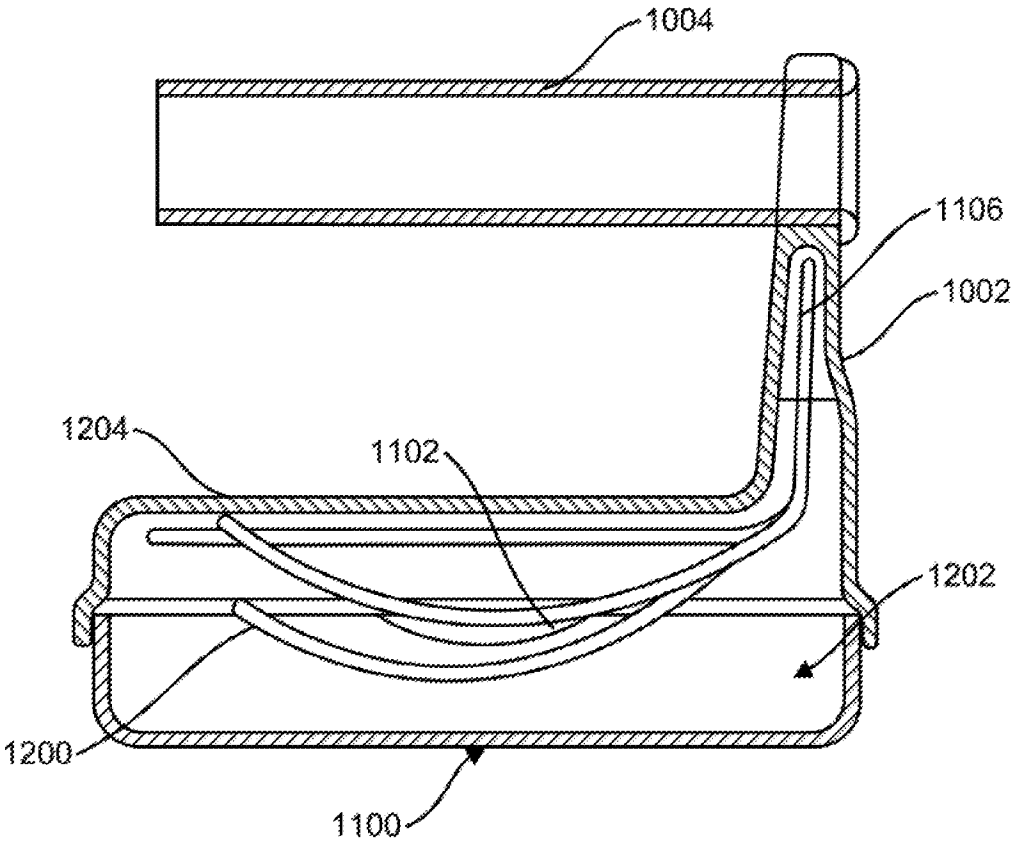
FIG. 12 is an midsection view of the bathroom wipe dispenser according to the third embodiment.

FIG. 12 is a midsection taken along line 12-12' of FIG. 10. Here the spring 1102 is shown at a first position of rest 1200 when the package 600 (not shown) is removed from an interior cavity 1202, and a second position of downward compression that occurs with the insertion of package 600.

Figure 14:
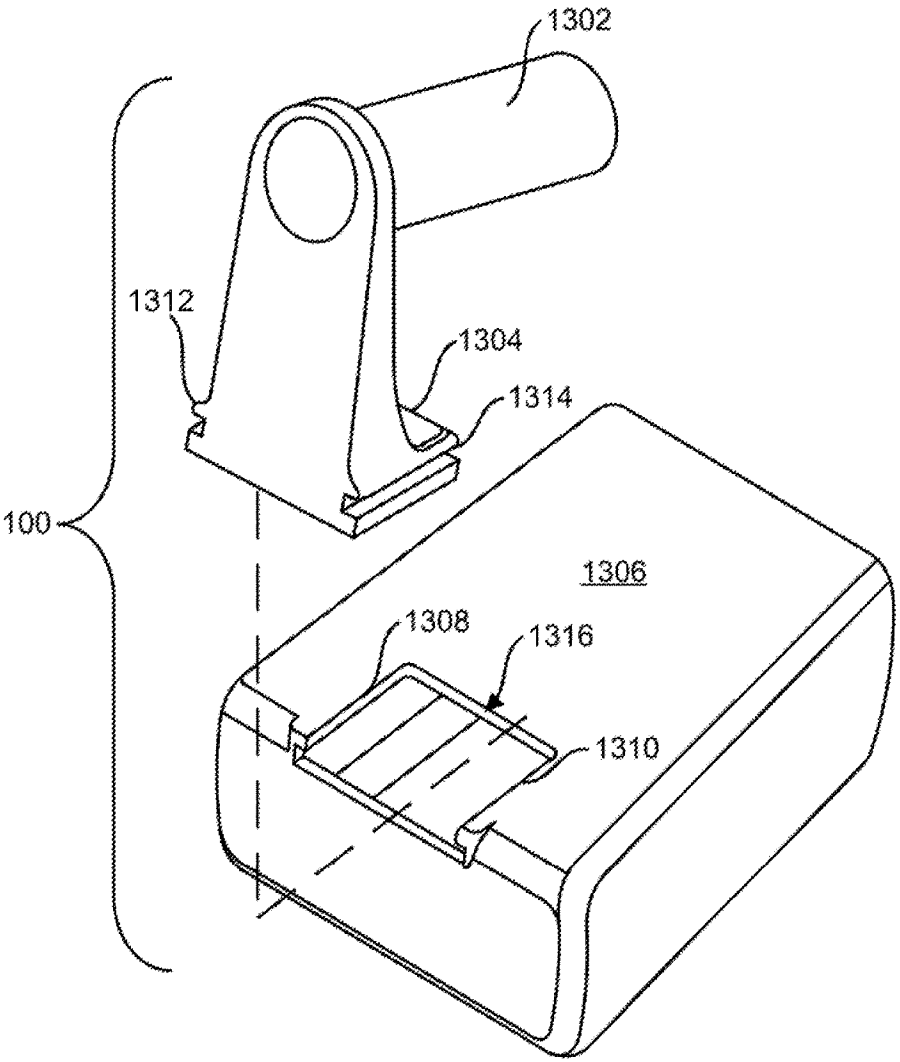
FIG. 14 is an assembly view showing attachment of the selectively detachable arm.
Figure 13:
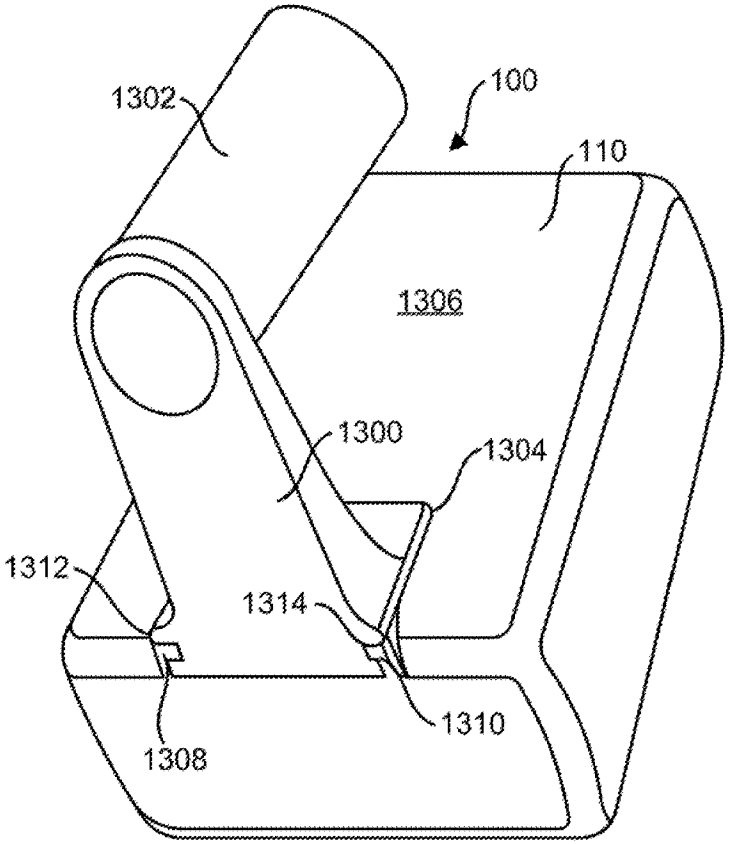
FIG. 13 shows a selectively detachable arm that may be used in any of the first, second or third embodiments.

FIG. 13 shows a removable arm that may be utilized in any of the first, second or third embodiments of the bathroom wipe dispenser 100. The arm 1300 includes a stabilizing tube 1302 positioned remote from a dovetail base 1304. A top wall 1306 of the wet wipe dispenser 110 is formed with rails 1308, 1310 that interfit with grooves 1312, 1314 in the dovetail base 1304. Thus, as shown in the assembly view of FIG. 14, the grooves 1312, 1314 of the dovetail base 1304 may slidingly engage rails 1308, 1310 as the dovetail base 1304 slides inward to cover opening 1316.

Those of ordinary skill in the art will understand that the foregoing discussion teaches by way of example and not be limitation. Accordingly, what is shown and described may be subjected to insubstantial change without departing from the scope and spirit of invention. The inventor hereby states his intention to rely upon the Doctrine of Equivalents, if needed, in protecting his full rights in the invention.

I claim:

1. A bathroom wipe dispenser comprising:

a toilet paper spindle having a first diameter;

a roll of toilet paper having a central opening therethrough, the opening presenting a second diameter a tube having a third diameter that is greater than the first diameter and less than the second diameter such that the toilet paper spindle passes through the tube and the tube passes through the central opening of the roll of toilet paper, the tube being constructed and arranged to dispense toilet paper while the toilet paper spindle is inserted in the tube;

a single arm hanging downwardly from a first end of the tube;

a wet wipe dispenser hanging from the arm at a second end of the arm remote from the tube;

the wet wipe dispenser having a compartment formed as a union of a main body and a selectively detachable sliding nose, the compartment having sufficient dimensions to retain a package of wet wipes therein, the compartment having a top and a bottom, the bottom defining an opening formed by the union of the main body and the sliding nose to present the opening for dispensing wet wipes therethrough from the bottom of the compartment, the sliding nose having a rolled wall atop which is formed a nib that flexes downwardly when manually depressed;

the sliding nose having a bottom side with a finger tab thereon, the finger tab being provided to assist withdrawal of the sliding nose from the compartment when the nib is manually depressed the top of the main body having a receptacle for retention of the nib when the sliding nose and the main body are joined to form the compartment, the top of the main body defining a top surface with a top opening that presents a pair of opposed rails, the single arm having a rising dimension extending between a first end connected to the tube and a second end coupled with the top opening;

the tube extending axially and perpendicular to the rising dimension to position the tube over the top surface and in parallel with the top surface, the second end of the arm including a dovetail base with grooves for receipt of the opposed rails such that the dovetail base may slide in a direction parallel with the top surface and into mating engagement with the pair of opposed rails for retention of the main body on the dovetail.

2. The bathroom wipe dispenser of claim 1, wherein the arm has a height H and the dispenser has a depth dimension D perpendicular to H, the depth dimension D being sufficient to cause an angle of inclination θ that departs from a vertical orientation as would occur when the arm hangs vertically without abutment to adjacent wall structure in the intended environment of use, the angle of inclination ranging from 20° and 40°, the angle of inclination increasing access to the bottom of the compartment by rotating the bottom upward and away from the adjacent wall structure, the angle of inclination increasing exposure of the bottom.

3. The bathroom wipe dispenser of claim 2, wherein the height H ranges from 6 to 12 centimeters.

4. The bathroom wipe dispenser of claim 3, wherein the end of the arm attaches to the wet wipe dispenser medially on the wet wipe dispenser, D is one half the total depth of the wet wipe dispenser, and H is greater than or equal to D.

5. The bathroom wipe dispenser of claim 1, wherein the opening has a chamfer of complimentary dimensions with respect to the package for enhanced retention thereof proximate the opening.

* * * * *